US005305852A

United States Patent [19]

Klokseth

[11] Patent Number: 5,305,852

[45] Date of Patent: Apr. 26, 1994

[54] APPARATUS FOR LOWERING PEOPLE FROM BUILDINGS AND THE LIKE

[76] Inventor: Per Klokseth, N-6375 Hovdenakken, Norway

[21] Appl. No.: 862,555

[22] PCT Filed: Dec. 19, 1990

[86] PCT No.: PCT/NO90/00191

§ 371 Date: Aug. 18, 1992

§ 102(e) Date: Aug. 18, 1992

[87] PCT Pub. No.: WO91/08798

PCT Pub. Date: Jun. 27, 1991

[30] Foreign Application Priority Data

Dec. 20, 1989 [NO] Norway ..... 895136

[51] Int. Cl.[5] ..... A62B 35/00

[52] U.S. Cl. ..... 182/241; 182/5; 182/231

[58] Field of Search ..... 182/231, 5-7, 182/236, 241; 188/65.1-65.4

[56] References Cited

U.S. PATENT DOCUMENTS

| | | | |
|---|---|---|---|
| 290,076 | 12/1883 | Lewis | 182/241 X |
| 659,093 | 10/1900 | Ockers | 182/241 |
| 870,777 | 11/1907 | Harkins | 182/236 |
| 924,695 | 6/1909 | Sheeley | 182/42 X |
| 992,902 | 5/1911 | Pouliot | 182/241 |
| 3,807,696 | 4/1974 | Brda | 182/241 X |
| 4,367,863 | 1/1983 | Dulondel | 182/5 X |
| 4,919,231 | 4/1990 | Klokseth | 182/5 |

FOREIGN PATENT DOCUMENTS

| | | | |
|---|---|---|---|
| 848874 | 11/1939 | France | 182/241 |
| 68799 | 6/1977 | Japan | 182/231 |

*Primary Examiner*—Alvin C. Chin-Shue
*Attorney, Agent, or Firm*—James E. Pittenger

[57] ABSTRACT

An apparatus for lowering people from a building or platform which includes a lowering line that is looped through a block member having a cylindrical ratchet with a grooved rim that is rotatably mounted on a shaft centrally positioned between two side plates forming the sides of the block member. The block member includes a longitudinal axis extending through the center of the shaft mounting the cylindrical ratchet and includes an attaching device which is offset a predetermined distance to one side of the longitudinal axis. On the opposite side of the block member from the attaching device is a pair of spaced pivots which make up a narrow entry and exit opening through which the incoming and outgoing ends of the lowering line extend. The pivots are equally spaced on either side of the longitudinal axis with the outgoing end of the lowering line passing adjacent to the pivot which is arranged on the opposite side of the longitudinal axis from the attaching device. The grooved rim of the cylindrical ratchet is formed as a pair of side walls which taper inward at a predetermined angle so as to produce friction between the side walls of the ratchet rim and the lowering line when a load is placed on the outgoing end of the line. A load on the lowering line causes a pawl to engage the ratchet and lock it from rotating in the downward direction and causes the block member to tilt toward the side corresponding to the outgoing end of the lowering line to bend the line around the pivot to increase and control the friction on the lowering line.

5 Claims, 1 Drawing Sheet

APPARATUS FOR LOWERING PEOPLE FROM BUILDINGS AND THE LIKE

The invention comprises an apparatus as stated for lowering people, particularly from buildings, platforms, posts and the like.

BACKGROUND OF THE INVENTION

Swedish Patent no. 452,951 describes a lowering apparatus that is to be used from buildings. This apparatus is not suited for universal applications. It is poorly suited for suspending people from their body which is required for mast assembly workers on oil platforms and the like.

U.S. Pat. No. 659,093 describes a lowering apparatus with a rope block where a grooved brake lever acts as the brake unit. However, the braking effect is difficult to control and so this device may not be too easy to use. The breaking effect is also difficult to adjust due to people having differing weights. This means that either children are lowered too slowly, or heavier adults will be lowered too quickly. Neither of these lowering devices are suited for releasing a person who is hanging unconscious, for example on a power line pole.

OBJECTIVE

The main objective of the invention is to design a lowering apparatus that can be adjusted to various areas of application. A particular objective is to design a lowering apparatus that is so light and compact that it can be worn by mast assembly workers, for example, and those working on high scaffolding and platforms. The lowering apparatus must be suitable to be used for releasing a worker in an emergency who is hanging from his pole climbing footwear on a power line pole.

SUMMARY OF THE INVENTION

Principle

It has been found that the use of such a brake device in the stated configuration provides sufficient braking with a wide range of loads. This safely provides adequate braking in a variety of applications. The apparatus makes it possible to stop the lowering process by a slight pull on the ingoing part of the line. A further advantage is that the new apparatus can be made to be small and relatively light.

DESCRIPTION OF THE DRAWING

The invention will be described below with reference to the drawings, where.

DETAILED DESCRIPTION OF THE DRAWING

Figure 1:
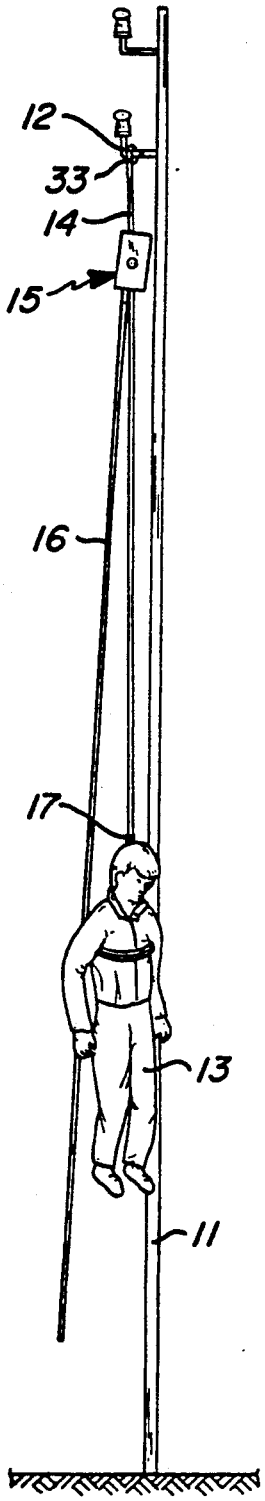
FIG. 1 illustrates a lowering situation where an apparatus in accordance with the invention is used.

FIG. 1 shows a power line post 11 with curved insulators 12. Here, there is a person 13, who has become incapacitated or has touched a live element so that he/she cannot get down without help. The drawing shows the lowering phase, after an assistant has secured the lowering apparatus in accordance with the invention, lifted the injured person from a hanging position, and loosened and removed that person's pole climbing footwear.

The apparatus in accordance with the invention has three main components: a securing line 14, a block 15 that the securing line 14 is attached to at one end, and a lowering line 16 which can be attached by a loop 17 around the upper part of a person 13 who requires help. The securing line 14 can have its free end tied to a higher point, in this case a curved insulator 12. The block 15 is shown in more detail in FIGS. 2 and 3.

Figure 2:
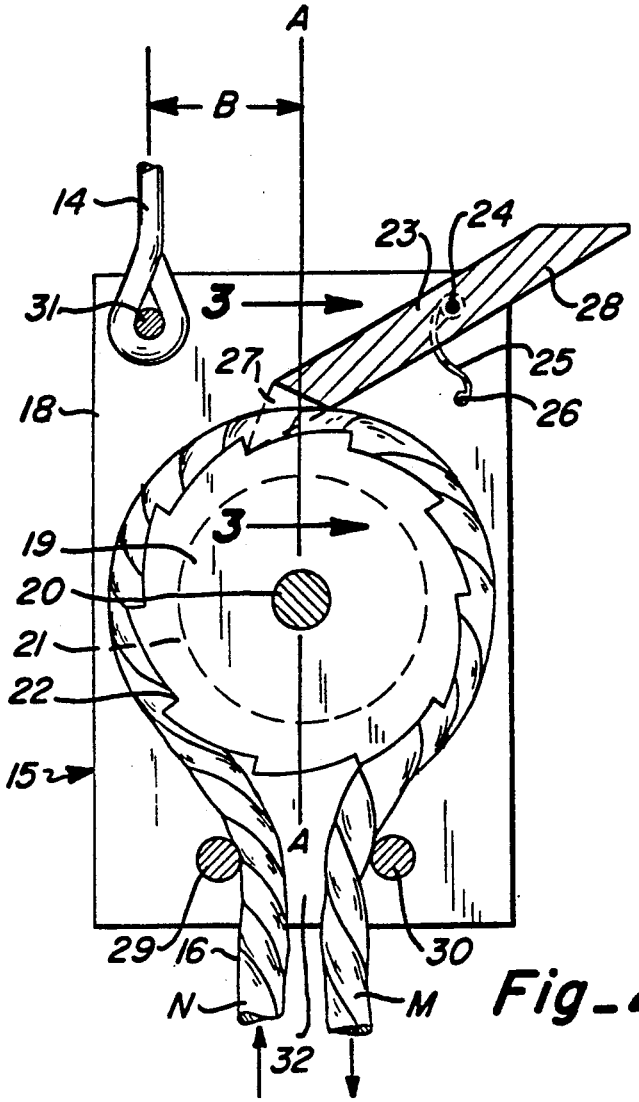
FIG. 2 shows a cross section of the block.
Figure 3:
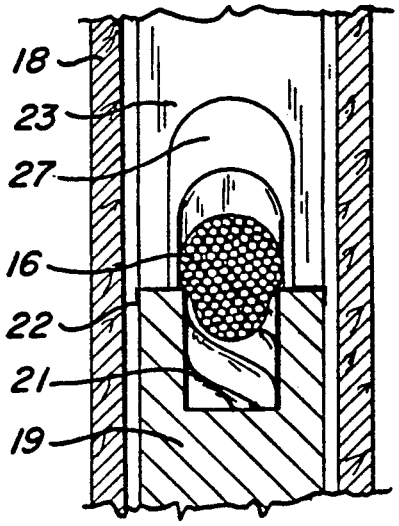
FIG. 3 shows part of a section through the ratchet mechanism.

The block 15 has two parallel, rectangular side plates 18, one of these is shown in FIG. 2. The side plates 18 support a ratchet 19 that is between them. This is freely mounted on a shaft 20 that in turn has its centre attached to side plates. The ratchet 19 has a grooved rim 21 that has parallel sides in the example. On the sides of the grooved rim 21 there are teeth 22 for a bifurcated pawl 23. The bifurcated pawl 23, that will be described in more detail below, is mounted on a shaft pivot 24 in a corner of the side plates 18. The pawl 23 is pressed to engage with the teeth 22 by a spring 25 attached to the shaft pivot 24 and fixed to another pivot 26 located on the side of the shaft pivot 24, and also attached to the side plates 18. The engagement end 27 of the pawl 23 is bifurcated or forked so that it surrounds the lowering line 16 without engaging it. The free end 28 of the pawl 23 protrudes outside the side plates 18 so that is accessible for release.

Near the rim of the ratchet 19 there is a pair of parallel pivots 29 and 30, that have combined guiding and braking functions. The respective distance between pivots 29 and 30 and the distance of the pivots to the ratchet 19 are adjusted to the diameter of the lowering line 16. The mode of operation will be described in more detail below.

At the upper edge of the side plates 18 in FIG. 2 there is a securing bolt 31 for the securing line 14 on the opposite side from the pawl 23. The securing bolt 31 for securing the support or attachment line 14 is offset a dimension B from the longitudinal axis A of the block 15 which passes through the center of the shaft 20. This offset is on the opposite side of the block 15 from the pivot 30 and the loaded or downward moving end M of the line 16. The securing line 14 has a hook 33 on its free end that can be hooked over an anchor point above the user, either while he/she is in a work situation where there is a risk of falling, or as in the example, when there has been an accident and the rescue crew is to lower the injured person.

The apparatus that is described in the example can also be used with a securing line 14 placed around the upper part of the user's body, while an end of the lowering line 16 is attached to a higher point. This solution may be satisfactory as a precaution, but is not suitable for rescue should an accident have occurred.

The apparatus in the example can be modified in various ways. The pawl can, for example, be built into the ratchet so that it is accessible and can be released through one of the side plates 18.

Also pivots 29 and 30 can be replaced by other types of guide units that together form a line guide opening 32. It is important that the line guide opening 32 is statically independent without any external forces being exerted, as is the case with the lowering apparatus in U.S. Pat. No. 659,093. If independent of such forces, the present invention will ensure stable braking that cannot be influenced by external conditions, such as rain or other precipitation.

The groove 21 has side walls that result in wedging the lowering line. This provides braking between the ratchet 19 and the lowering line 16. The side walls of the groove 21 can be slightly convergent towards their base, with a maximum of about 20 degrees on each side. Preferably much less, and under 7.5 degrees.

The offset dimension B for the securing bolt 31 and line 14 causes the rectangular side plates 18 of the block 15 to tilt downward on the right side as viewed in FIG. 2 when a load is applied to the downward moving end M of the line 16. This canting or tilting of the entire block 15 causes the end M of the line 16 to crimp or bend around the pivot 30 increasing the friction on the line 16 and holding the line in contact with the perimeter of the ratchet groove 21. In this way a greater friction load can be produced on the line during the loading and use of the lowering apparatus according to the present invention.

I claim:

1. An apparatus for lowering people from a high level, for example from a building, a post, a platform or scaffolding, the apparatus including a lowering line that is looped through a block member having a cylindrical ratchet means with a grooved rim that is rotatably mounted on a shaft centrally positioned between two side plates forming the sides of the block member, the improvement comprising a pawl means that is pivotally mounted between said side plates and is positioned to engage teeth formed around the outer perimeter of the rim of the ratchet means; said block member includes a longitudinal axis extending through the center of the shaft mounting said cylindrical ratchet means; said block member includes attaching means which is offset a predetermined distance to one side of said longitudinal axis and at the opposite end of said block member from said attaching means is a narrow entry and exit opening means through which the incoming and outgoing ends of the lowering line extend after passing around the cylindrical ratchet means; said narrow entry and exit opening means being formed by a pair of spaced pivots equally spaced on either side of said longitudinal axis with the outgoing end of the lowering line passing adjacent to the pivot which is arranged on the opposite side of the longitudinal axis from the attaching means; said attaching means includes an anchor pin attached between said side plates and an attachment line connected to said anchor pin which extends outwardly from said block member so that it can be attached to a secure object for suspending the apparatus; and the grooved rim of the ratchet means is formed as a pair of side walls which taper inward at a predetermined angle so as to produce friction between the side walls of the ratchet rim and the lowering line when a load is placed on the outgoing end of the lowering line causing the pawl means to engage the ratchet teeth and lock the ratchet means from rotating in the downward direction and cause the block member to tilt on a side corresponding to the pivot engaging the outgoing end of the lowering line to bend the line around the pivot to increase the friction on the lowering line.

2. An apparatus as described in claim 1 wherein the pawl means has a bifurcated end which is arranged to engage the teeth formed on the perimeter of the grooved rim of the cylindrical ratchet means, the bifurcated end being arranged to straddle the lowering line positioned in the grooved rim of the ratchet means.

3. An apparatus as described in claim 1 wherein the pawl means is elongated and rotatably mounted so that the end of the pawl means opposite the end which engages the teeth on the rim of the ratchet means is exposed beyond the block member so that the pawl means can be manually moved to disengage from the teeth on the rim of the ratchet means.

4. An apparatus as described in claim 1 wherein each of the side walls of the grooved rim taper inwardly at an angle of 1–15 degrees.

5. An apparatus as described in claim 4 wherein the taper angle on each of said side walls is less than 7.5 degrees.

* * * * *